US006234456B1

(12) United States Patent
Gerhardy

(10) Patent No.: US 6,234,456 B1
(45) Date of Patent: May 22, 2001

(54) DIAPHRAGM CARBURETOR

(75) Inventor: Reinhard Gerhardy, Korb (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/360,105

(22) Filed: Jul. 23, 1999

(30) Foreign Application Priority Data

Jul. 25, 1998 (DE) ..... 198 33 540

(51) Int. Cl.[7] ..... F02M 17/04

(52) U.S. Cl. ..... 261/35; 261/64.1; 261/69.2; 261/DIG. 68

(58) Field of Search ..... 261/34.1, 37, 35, 261/54, 64.1, 69.1, 69.2, 71, DIG. 23, DIG. 24, DIG. 38, DIG. 39, DIG. 68, DIG. 83, DIG. 84

(56) References Cited

U.S. PATENT DOCUMENTS 3,045,605 * 7/1962 Nutten et al. ..... 261/35 X
3,072,390 * 1/1963 Phillips ..... 261/35
3,231,249 * 1/1966 Kalert, Jr. ..... 261/DIG. 68
3,275,305 * 9/1966 Nutten ..... 261/34.1
3,791,632 * 2/1974 Donovan ..... 261/DIG. 68
4,104,994 * 8/1978 Phillips ..... 261/DIG. 68
5,283,013 * 2/1994 Gerhardy ..... 261/35
5,441,673 * 8/1995 Gerhardy ..... 261/35 X
5,542,405 * 8/1996 Gerhardy ..... 261/34.1 X
6,059,271 * 5/2000 Gerhardy ..... 261/35

* cited by examiner

*Primary Examiner*—Richard L. Chiesa
(74) *Attorney, Agent, or Firm*—Robert W. Becker & Associates

(57) ABSTRACT

A diaphragm carburetor for an internal combustion engine has a carburetor housing having an intake channel with a venturi section. A plate valve is positioned in the intake channel. A fuel outlet valve is mounted in the venturi section. A fuel-filled control chamber is provided and delimited at one side by a diaphragm. A fuel supply channel is connected to the control chamber. A supply valve is mounted in the fuel supply channel and actuated by the diaphragm. A first fuel channel connects the control chamber and the fuel outlet valve. At least one fixed main throttle is mounted in the first fuel channel for fixedly determining a fuel flow cross-section to the fuel outlet valve. A lever is provided for actuating the valve plate. An adjustable stop cooperates with the lever. The flow cross-section of the intake air is adjusted by the stop to a desired air/fuel ratio and is changeable, in a limited range, in a direction of increasing the flow cross-section.

10 Claims, 2 Drawing Sheets

DIAPHRAGM CARBURETOR

BACKGROUND OF THE INVENTION

The present invention relates to a diaphragm carburetor for an internal combustion engine, especially for a two-stroke engine having in a carburetor housing an intake channel for guiding combustion air into the internal combustion engine. The intake channel has a venturi section and upstream of the venturi section a throttle valve. A fuel-filled control chamber is provided which is connectable by an inlet valve operated by a control diaphragm to the fuel supply channel. A first fuel channel extends from the control chamber to a main outlet valve in the venturi section.

In hand-guided working tools such as motor chainsaws, cutters, trimmers etc., it is common to employ two-stroke engines as a drive means. In order to provide the two-stroke engine with the required fuel/air mixture, diaphragm carburetors are known which comprise in a carburetor housing an intake channel which supplies the combustion air into the internal combustion engine. The intake channel has a venturi section. Upstream of the venturi section a throttle valve is arranged with which the flow cross-section for the intake air can be adjusted as a function of the throttle actuation. The throttle valve cooperates with a full load stop which is unchangeable. Because of manufacturing and assembly tolerances, the flow cross-section for the combustion or intake air is not exactly identical; usually, considerable differences are observed, especially because of deviations of the throttle valve angle in the open position in the range of ±3°.

Furthermore, such a diaphragm carburetor has a fuel-filled control chamber which can be connected by a fuel inlet valve controlled by the control diaphragm to the fuel supply channel. A first fuel channel extends from the control chamber to a main outlet valve that is arranged within the venturi section of the intake channel. A second fuel channel extends from the control chamber to an idle valve which is arranged in the area of the throttle valve of the intake channel. Within the passage way to the main outlet valve as well as in the passage way to the idle valve, control valves in the form of adjusting screws having ends in the form of a valve cone are provided so that the fuel ratio for the respective load condition, i.e., idle condition or full load condition, can be adjusted to the desired λ value. However, with this construction even minimal changes or manufacturing tolerances cause considerable fuel/air ratio changes which remain within the limits set by respective regulations, but the corresponding specifications can be reached only with very high manufacturing and adjusting expenditures. Due to the minimal flow cross-section of these screw valves, multiple disturbing influences are present, for example, due to temperature-depending viscosity changes of the fuel and the soiling of the valve so that a substantial change of the fuel/air mixture composition will result which affects the operational behavior of the combustion engine.

It is therefore an object of the present invention to provide a diaphragm carburetor for an internal combustion engine of the aforementioned kind in which in a simple manner with utmost precision the mixture composition of fuel and air can be adjusted so that a reduced band width of the λ range for full load is achieved.

SUMMARY OF THE INVENTION

According to the present invention it is suggested that the cross-section for the fuel flow to the fuel inlet valve is fixed by at least one main throttle and that a plate valve arranged within the intake channel is acted upon by a lever which cooperates with an adjustable stop with which the flow cross-section for the intake air can be adjusted to a desired rich mixture limit and changed within a limited range in the direction of increasing the cross-section.

The essential advantages of the invention are that, by eliminating the control valve at the fuel side within the main passage way, a simple and inexpensive arrangement is provided and that temperature and soiling effects are minimized. In order to determine the constant fuel flow within the first fuel passage way, i.e., the main passage way, as exactly as possible, a main throttle is provided that is unchangeable (fixed). The lever connected to the plate valve in conjunction with the stop determines the rich mixture limit, i.e., the variable stop allows to adjust an increasing flow cross-section for the combustion air from the rich mixture limit in a direction toward a leaner mixture. Because of the fixed main throttle, the fuel-side adjustment remains at 100%.

According to one embodiment, the flow cross-section for the intake air is determined by the position of the throttle valve, i.e., the lever is connected to the shaft of throttle valve. In the alternative, the lever can also be connected to the shaft of a choke valve arranged upstream of the venturi section so that the flow cross-section for the intake air is determined by the position of the choke valve. The adjusting potential for the combustion air can thus be provided either at either one of the plate valves, i.e., the throttle valve or at the choke valve.

In order to provide a simple adjusting device with respect to manufacture and handling, it is expedient to provide the stop in the form of an adjusting screw that is threaded into a threaded bore of the carburetor housing. In known diaphragm carburetors in which the adjustment of the mixture is carried out with respect to the supplied amount of fuel, it is common to rotate the adjusting screw in a clockwise direction for making the mixture more lean. In order to provide the same kind of actuation with the inventive diaphragm carburetor, the direction of rotation of the adjusting screw should thus be set such that a counter clockwise rotation results in a reduction of the cross-section for the intake air. The adjusting range for the plate valve (choke valve or throttle valve) between a first position for a full load condition, i.e., a rich mixture limit, and an upper limit for the full load condition, i.e., a lean mixture limit, should be within a range of 85% for the rich mixture limit and 100% for the lean mixture limit provided for the intake flow cross-section. Between these positions lies the adjusting range for making the mixture more lean for output optimization or altitude adjustment. This corresponds to the rich mixture stop (the H screw), respectively, the lean mixture stop by limiter caps in known diaphragm carburetors. The pitch of the screw thread should be such that the deflection of the lever about the axis of rotation of the plate valve shaft to accomplish the entire adjusting stroke between the rich mixture limit and the lean mixture limit is provided by a rotation of the adjusting screw of approximately 270°.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 and 2.

Figure 1:
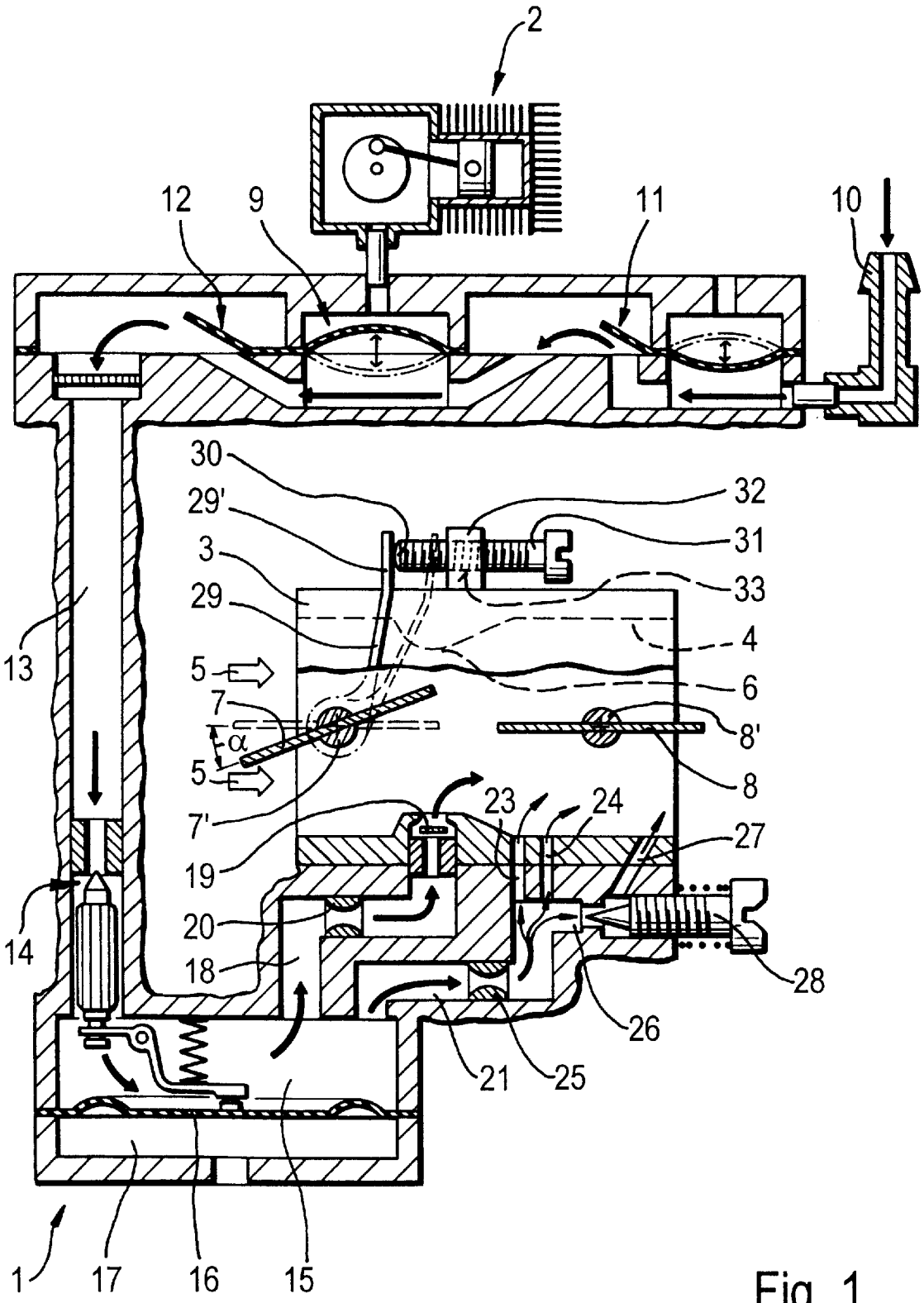
FIG. 1 shows a diaphragm carburetor with an adjusting device at the air intake side for the value at a choke valve.

The diaphragm carburetor 1 represented in FIG. 1 serves for preparing a fuel/air mixture for the combustion engine 2, especially a two-stroke engine. Such a two-stroke engine is preferably provided in a hand-guided working tool such as a lawnmower, cutter, trimmer or motor chainsaw. In the carburetor housing 3 a suction or intake channel 4 is provided via which, in the direction of arrows 5, combustion air flows into the internal combustion engine 2. In the intake channel 4 a venturi section 6 is provided. Upstream of the venturi section a choke valve 7 is arranged on a choke valve shaft 7'. Upstream of the venturi section 6 a throttle valve shaft 8' having pivotably connected thereto a throttle valve 8 is provided. The throttle valve shaft 8 is actuated in a manner known to a person skilled in the art by a non-represented gas pull or gas linkage.

For supplying fuel a fuel pump 9 is provided which is loaded by the pressure present within the crankcase of the internal combustion engine. The fuel pump 9 takes in fuel from a fuel tank via suction socket 10. The fuel pump 9 has a suction valve 11 and a pressure valve 12 correlated therewith which are embodied as check valves. The diaphragm carburetor 1 comprises furthermore a fuel-filled control chamber 15 which is delimited by a control diaphragm 16. Opposite the control chamber 15, a compensation chamber 17. The control chamber 15 is connected by a fuel supply channel 13 to the pressure valve 12 whereby the incoming fuel amount is controlled as a function of the position of the control diaphragm 16 acting on the supply valve 14.

A first fuel channel 18 extends from the control chamber 15 to a main outlet valve 19 which is arranged within the venturi section 6. In the first fuel channel 18 a fixed main throttle 20 is provided for limiting the cross-section and thus the amount of fuel for full load operation. The fixed main throttle 20 is not necessarily positioned as shown in FIG. 1 in the first fuel channel 18, it can, if needed, also be positioned directly adjacent to the control chamber 15 or closer to the main outlet valve 19. The main outlet valve 19 is embodied as a check valve whereby preferably a valve plate is provided that, as a function of the vacuum present within the venturi section 6, is lifted off its seat and thus opens the main outlet valve 19. The valve plate closes during idling the main outlet valve 19.

According to FIG. 1 a second fuel channel 21 is provided which extends from the control chamber 15 to two bypass bores 23 and 24 which are arranged in the area of the throttle valve 8 in the intake channel 4. Furthermore, another fuel channel 26 is provided which branches off downstream of the fixed throttle 25 from the second fuel channel 21 and extends to an outlet bore 27 in the intake channel 4. In this fuel channel 26 an idle control screw 28 is provided with which the flow cross-section of the fuel channel 26 for idle conditions can be varied.

During full load operation the idle system participates in the supply of fuel to the combustion engine. The idle system is primarily designed for providing idle conditions but is also designed such that during full load conditions a certain preset amount of fuel can be contributed to the amount of fuel supplied via the idle valves to the internal combustion engine. The position of the idle control screw 28 has no effect on full load operation.

As can be seen in FIG. 1, on the choke valve shaft 7' a lever 29 is fastened having a free end 29' that rests at the stop 30. The stop 30 is formed by the forward end of an adjusting screw 31 which is threaded into the threaded bore 33 provided at the housing projection 32. Upon rotation of the adjusting screw 31, the position of the stop 30 is changed so that the end position of the lever 29 is changed also. The position of the lever 29 determines the end position of the choke valve 7 so that, depending on the position of the adjusting screw 31, respectively, the stop 30, the lever 29 with the choke valve 7 has different end positions as indicated by the dashed representation of a second position of the lever 29 and of the choke valve 7. The angle $\alpha$ between the two represented positions of the choke valve 7 is preferably between 10° and 15°, whereby however also other angular ranges are possible.

The system disclosed in connection with FIG. 1 has two fixed fuel systems that determine full load, i.e., the main fixed throttle 20 and the fixed throttle 25, as well as an adjustable air throttle which is designed such that it meets the requirements especially with respect to exhaust gas regulations and output. At the fuel side, a fixed adjustment to 100% is provided. The adjustable stop 30 provides the possibility to increase the air intake so that a leaner mixture can be achieved which can be used for output optimization and/or altitude adjustment.

Figure 2:
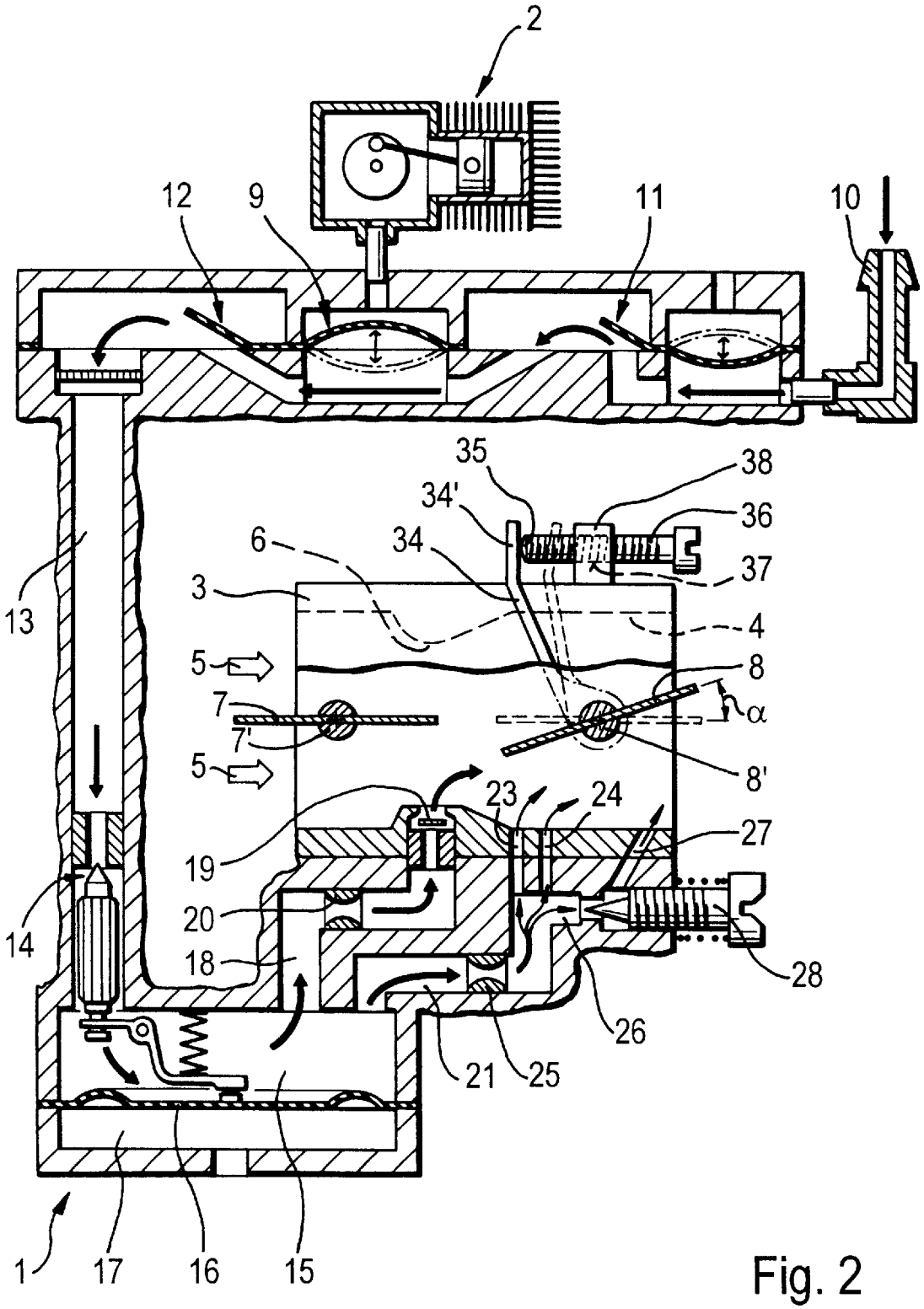
FIG. 2 shows an embodiment variation with respect to FIG. 1 in which the adjusting device acts unto the throttle valve of the diaphragm carburetor.

FIG. 2 shows a diaphragm carburetor 1 which corresponds substantially to the one shown in FIG. 1 so that in the following only differences to the representation of FIG. 1 will be pointed out. Identical parts are identified by the same reference numerals so that for avoiding repetition reference is made to the disclosure provided in connection with FIG. 1.

As can be seen in FIG. 2, the adjustment of the cross-section for full load operation is not provided at the choke valve 7, but instead at the throttle valve 8. A lever 34 is fastened to the throttle valve shaft 8' and has a free end 34' resting at the stop 35. The stop 35 is embodied by the forward end of the adjusting screw 36. The adjusting screw 36 is provided in a threaded bore 37 of a projection 38 provided at the carburetor housing 3. FIG. 2 also shows in dashed lines a second position of the throttle valve 8 and of the lever 34 which indicates the adjusting range between the minimum flow cross-section at full load and the maximum flow cross-section at full load. The angle between these two positions is also between 10° and 15°, as disclosed in connection with FIG. 1.

According to the present invention, for adjusting the $\lambda$ value only changes at the air side are performed. The potential for producing a leaner mixture is realized by the angular range of the plate valve, either the choke valve 7 according to FIG. 1 or the throttle valve 8 according to FIG. 2, between the position for the minimum flow cross-section at full load and the maximum position at full load (indicated by dashed lines). Between the two positions it is, of course, possible to adjust any other intermediate position. For this purpose the adjusting screw 31, 36 is provided whereby, upon rotation of the screw 31, 36 and the resulting longitudinal movement, the stop 30, 35 is changed. In both representations FIGS. 1 and 2 the adjusting screw 31, 36 has a left-handed thread. This is advantageous because the conventional rotational direction for making the mixture more lean, as is known in regard to carburetors where the adjustment is provided at the fuel side, is maintained with the inventive diaphragm carburetor where the adjustment is carried out at the air side. Thus, the same adjustment action is to be carried out by the operator, and confusion is avoided.

The mixture adjustment by changing the air intake allows a substantially finer adjustment so that a substantially improved approximation to an optimal λ value is possible.

The specification incorporates by reference the disclosure of German priority document 198 33 540.7 of Jul. 25, 1998.

The present invention is, of course, in no way restricted to the specific disclosure of the specification and drawings, but also encompasses any modifications within the scope of the appended claims.

What is claimed is:

1. A diaphragm carburetor for an internal combustion engine, said carburetor comprising:

a carburetor housing (3) having an intake channel (4) with a venturi section (6);

a plate valve (7, 8) positioned in said intake channel (4);

a fuel outlet valve (19) mounted in said venturi section (6);

a fuel-filled control chamber (15);

a diaphragm (16) delimiting one side of said control chamber (15);

a fuel supply channel (13) connected to said control chamber (15);

a supply valve (14) mounted in said fuel supply channel (13) and actuated by said diaphragm (16);

a first fuel channel (18) connected to said control chamber (15) and said fuel outlet valve (19);

at least one main throttle (20) mounted in said first fuel channel (18) having a fixed fuel flow cross-section;

at least one fixed throttle (25) mounted in a second fuel channel (21) for providing a constant fuel flow to said at least one main throttle (20);

a lever (29, 34) actuating said plate valve (7, 8);

an adjustable stop (30, 35) cooperating with said lever (29, 34), wherein a flow cross-section of the intake air is adjusted by said stop (30, 35) to a desired rich mixture limit and is changeable, in a limited range, in a direction of increasing the flow cross-section.

2. A carburetor according to claim 1, wherein said lever (29, 34) is connected to a shaft (7', 8') of said plate valve (7, 8).

3. A carburetor according to claim 2, wherein said lever (29, 34) is riveted to said shaft (7', 8').

4. A carburetor according to claim 1, wherein said stop (30, 35) is continuously adjustable, wherein said lever (29, 34) has a free end, and wherein a stroke limitation of said lever (29, 34) is realized when said free end (29', 34') contacts said stop (30, 35).

5. A carburetor according to claim 1, wherein said plate valve is a throttle valve (8) positioned downstream of said venturi section.

6. A carburetor according to claim 1, wherein said plate valve is a choke valve (7) positioned upstream of said venturi section (6).

7. A carburetor according to claim 1, wherein said stop (30, 35) is an adjusting screw (31, 36) threaded into a threaded bore (33, 37) of said carburetor housing (3).

8. A carburetor according to claim 7, wherein a rotation of said adjusting screw (31, 36) between a first end position, defining a minimal flow cross-section of the intake air, and a second end position, defining a maximum flow cross-section of the intake air, is approximately 270°.

9. A carburetor according to claim 7, wherein a direction of rotation of said adjusting screw (31, 36) is such that turning in a clockwise direction causes a reduction of the flow-cross-section of the intake air.

10. A carburetor according to claim 1, wherein an adjusting range of said plate valve (7, 8) is from 85% to 100% of a flow cross-section of said intake channel (4).

* * * * *